US005881568A

United States Patent [19]

Kim

[11] Patent Number: 5,881,568

[45] Date of Patent: Mar. 16, 1999

[54] REFRIGERATOR

[75] Inventor: Cheol-Min Kim, Seoul, Rep. of Korea

[73] Assignee: LG Electronics Inc., Seoul, Rep. of Korea

[21] Appl. No.: 842,109

[22] Filed: Apr. 28, 1997

[30] Foreign Application Priority Data

Apr. 29, 1996 [KR] Rep. of Korea ..... 1996-13486

[51] Int. Cl.[6] ..... F25D 17/06

[52] U.S. Cl. ..... 62/443; 251/253

[58] Field of Search ..... 62/187, 186, 443–446; 251/229, 253; 454/161

[56] References Cited

U.S. PATENT DOCUMENTS

| | | | |
|---|---|---|---|
| 2,982,115 | 5/1961 | Wurtz et al. | 62/443 |
| 3,320,761 | 5/1967 | Gelbard | 62/443 |
| 4,122,687 | 10/1978 | McKee | 62/187 |
| 4,407,354 | 10/1983 | Takishita et al. | 454/161 |
| 4,614,092 | 9/1986 | Kim et al. | 62/187 |
| 5,191,774 | 3/1993 | Park | 251/253 |
| 5,375,428 | 12/1994 | LeClear et al. | 62/187 |
| 5,460,011 | 10/1995 | Martin | 62/187 |

*Primary Examiner*—William E. Tapolcai
*Attorney, Agent, or Firm*—Finnegan, Henderson, Farabow, Garrett & Dunner, L.L.P.

[57] ABSTRACT

A refrigerator having a freezing compartment, a fresh food compartment, and a damper for opening/closing a freezing compartment passage and a fresh food compartment passage through which a cooling air via an evaporator flows, including a freezing compartment fan installed in a cooling air duct for the freezing compartment, a fresh food compartment fan installed in a cooling air duct for the fresh food compartment, and a single damper for opening/closing the freezing compartment passage and the fresh food compartment passage.

4 Claims, 2 Drawing Sheets

REFRIGERATOR

BACKGROUND OF THE INVENTION

1. Field of the Invention

The present invention relate to a refrigerator, and more particularly, to a refrigerator which is capable of adjusting an amount of cooling air flowing into a freezing compartment and a fresh food compartment by means of a single damper.

2. Discussion of Related Art

FIG. 1 is a partly sectional view illustrating a conventional refrigerator. In the conventional refrigerator, as shown in FIG. 1, there are provided a freezing compartment 1 and a fresh food compartment 2. A cooling air passing through an evaporator 4 flows into the freezing compartment 1 and the fresh food compartment 2 via a fan 3.

In the case where cooling for the fresh food compartment 2 is needed, a cooling air inlet damper 5 provided in front of the evaporator 4 is adapted to open a cooling air circulating duct 10 for the fresh food compartment 2. As a result, the air in the fresh food compartment 2 is passed through the evaporator 4 by means of the fan 3 and is then cooled. Further, a cooling air outlet damper 6 provided in the rear portion of the evaporator 4 is adapted to open a cooling air duct 8 for the fresh food compartment 2. Thus, the air is passed through the evaporator 4 and then flows into the fresh food compartment 2.

In the case where cooling for the freezing compartment 1 is needed, the cooling air inlet damper 5 provided in front of the evaporator 4 is adapted to open a cooling air circulating duct 9 for the freezing compartment 1. Then, the air in the freezing compartment 1 is passed through the evaporator 4 by means of the fan 3 and is then cooled. Further, the cooling air outlet damper 6 provided in the rear portion of the evaporator 4 is adapted to open a cooling air duct 7 for the freezing compartment 1. Thus, the air is passed through the evaporator 4 and then flows into the freezing compartment 1.

However, the use of two dampers in the conventional refrigerator creates problems. Namely, a great number of assembling components are required and the overall structure is complicated. Moreover, since a single fan is provided in the conventional refrigerator, the installation thereof is structurally difficult and airflow is greatly reduced.

SUMMARY OF THE INVENTION

Accordingly, the present invention is directed to a refrigerator that substantially obviates one or more of the problems due to limitations and disadvantages of the related art.

The object of the invention is to provide a refrigerator that is capable of achieving a simple structure, using a single damper and ensuring a sufficient airflow, by installing two fans in a cooling air duct for the fresh food compartment and a cooling air duct for the freezing compartment, respectively.

To accomplish this and other objects of the present invention, a refrigerator having a freezing compartment, a fresh food compartment, and a damper for opening/closing a freezing compartment passage and a fresh food compartment passage through which a cooling air via an evaporator flows, includes a freezing compartment fan installed in a cooling air duct for the freezing compartment, a fresh food compartment fan installed in a cooling air duct for the fresh food compartment, and a single damper for opening/closing the freezing compartment passage and the fresh food compartment passage.

It is to be understood that both the foregoing general description and the following detailed description are exemplary and explanatory only and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

DETAILED DESCRIPTION OF PREFERRED EMBODIMENT

Reference will now be made in detail to the preferred embodiments of the present invention, examples of which are illustrated in the accompanying drawings.

Figure 1:
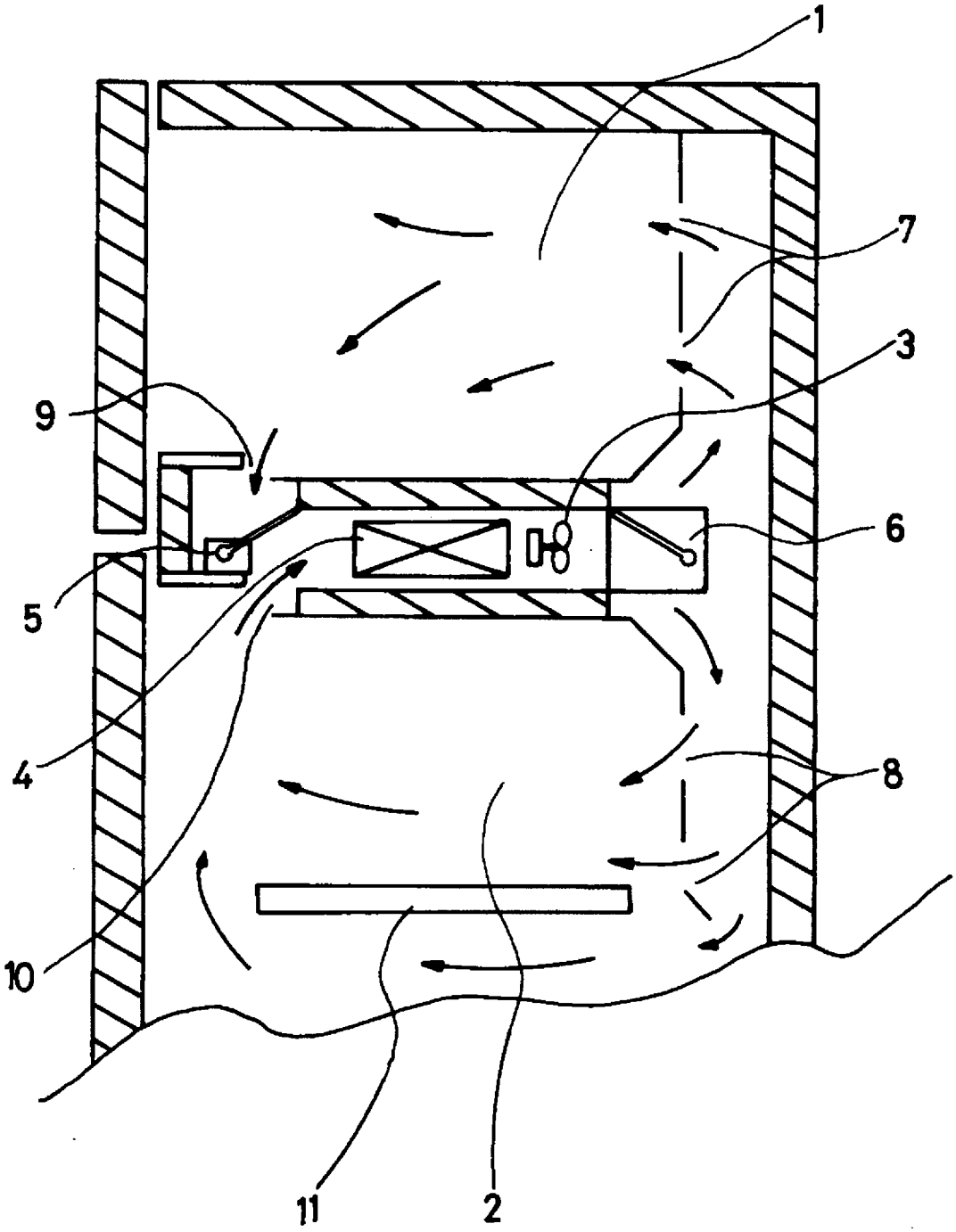
Fig. 1 (Prior Art)
FIG. 1 is a partly sectional view illustrating a conventional refrigerator.
Figure 2:
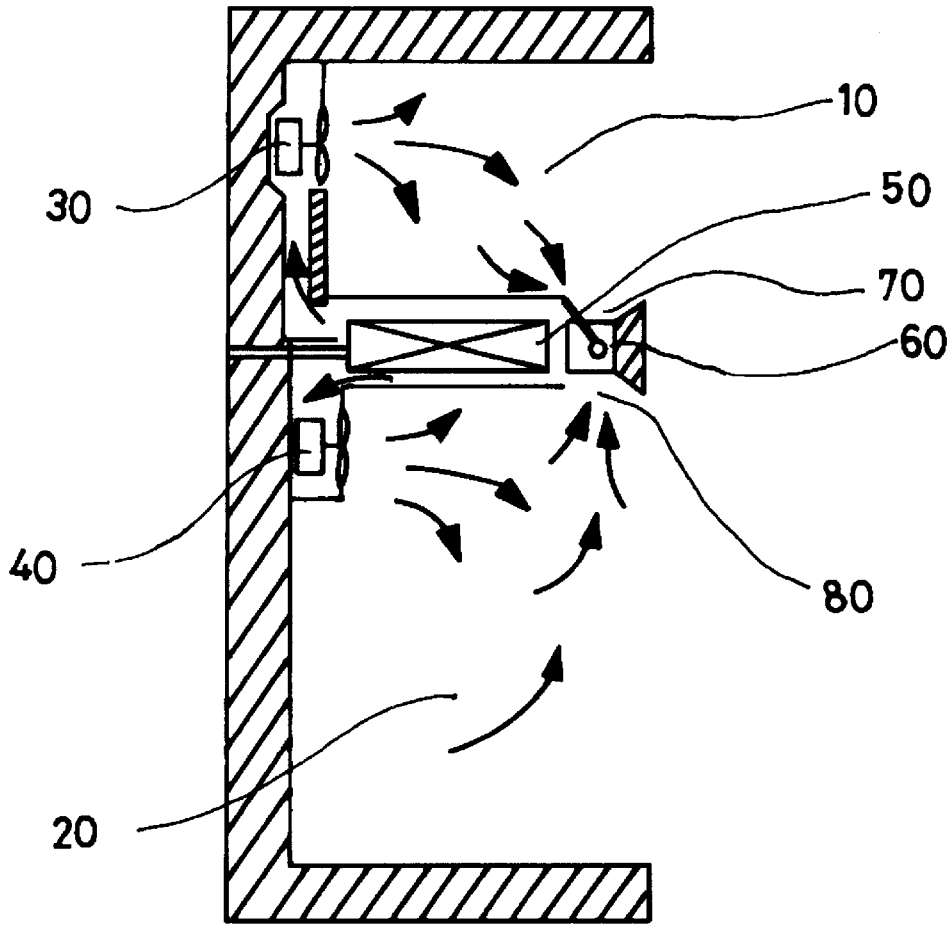
FIG. 2 is a partly sectional view illustrating a refrigerator constructed according to the present invention.

FIG. 2 is a partly sectional view illustrating a refrigerator constructed according to the present invention. In the figure, a freezing compartment fan 30 is installed in a freezing compartment 10, and a fresh food compartment fan 40 is installed in a fresh food compartment 20. At the inlet of an evaporator 50, there are provided a cooling air duct 70 for the freezing compartment 10 for connecting the evaporator 50 and the freezing compartment 10 and a damper 60 for selectively opening/closing a cooling air duct 80 for the fresh food compartment 20 which connects the evaporator 50 and the fresh food compartment 20.

Figure 3:
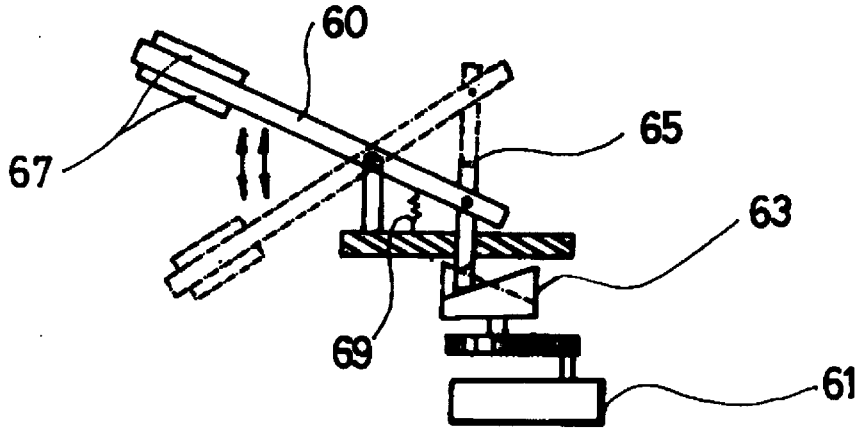
FIG. 3 is a detailed view illustrating a damper 60 of FIG. 2.

Preferably, the damper 60 is comprised of, as shown in FIG. 3, a motor 61, a cam 63 which is engaged with the motor 61, a damper supporting bar 65 which is moved upward and downward in accordance with the rotation of cam 63, a high density styrol plastic 67 which is disposed on the end portions of the damper 60, for opening/closing the cooling air duct 70 for the freezing compartment 10 and the cooling air duct 80 for the fresh food compartment 20, and a spring 69 which supports the damper 60 by a predetermined force.

In operation, in the case where cooling for the freezing compartment 10 is needed, the motor 61 is driven to rotate and the cam 63 is accordingly rotated. Then, the damper supporting bar 65 is moved upward. As a result, by means of the high density styrol plastic 67, the damper 60 opens the cooling air duct 70 for the freezing compartment 10 and closes the cooling air duct 80 for the fresh food compartment 20. Hence, the air in the freezing compartment 10 flows towards the evaporator 50 via the cooling air duct 70, while being effected by the operation of the freezing compartment fan 30. Then, the air is passed through the evaporator 50 and is cooled. Finally, the cooling air again flows into the freezing compartment 10.

Meanwhile, in the case where cooling for the fresh food compartment 20 is needed, the damper 60 opens the cooling air duct 80 for the fresh food compartment 20 and closes the cooling air duct 70 for the freezing compartment 10. Hence, the air in the fresh food compartment 20 flows towards the evaporator 50 via the cooling air duct 80 for the fresh food compartment 20 opened, while being effected by the operation of the fresh food compartment fan 40. Then, the air is passed through the evaporator 50 and is cooled. Finally, the cooling air again flows into the fresh food compartment 20.

If the temperatures in the freezing compartment 10 and the fresh food compartment 20 are both satisfied, the damper 60 closes the cooling air duct 70 for the freezing compartment 10, so that it can prevent the cooling air in the freezing compartment 10 from flowing into the fresh food compartment 20 and the evaporator 50.

As set forth above, a refrigerator according to the present invention is capable of achieving a simple structure, using a single damper and ensuring a sufficient airflow, by installing a fan in a cooling air duct for the fresh food compartment and a cooling air duct for the freezing compartment, respectively.

It will be apparent to those skilled in the art that various modifications and variations can be made in a refrigerator of the present invention without departing from the spirit or scope of the invention. Thus, it is intended that the present invention cover the modifications and variations of this invention provided they come within the scope of the appended claims and their equivalents.

What is claimed is:

1. A refrigerator having a freezer compartment, a fresh food compartment, a freezer compartment passage for circulating air to and from the freezer compartment, a fresh food compartment passage for circulating air to and from the fresh food compartment, and an evaporator for removing heat from air flowing through the freezer compartment passage and from air flowing through the fresh food compartment passage, said refrigerator comprising:

a freezer compartment fan for forcing air through the freezer compartment passage;

a fresh food compartment fan for forcing air through the fresh food compartment passage; and a single damper for opening and closing said freezer compartment passage and said fresh food compartment passage, said single damper comprising a cam, a motor for moving the cam, and an opening/closing member for opening and closing said freezer compartment passage and said fresh food compartment passage in accordance with the movement of said cam.

2. The refrigerator as claimed in claim 1, wherein said opening/closing member is supported by an elastic member applying a predetermined force.

3. A refrigerator comprising:

a freezer compartment;

a fresh food compartment;

a first cooling duct having an inlet and outlet in flow communication with the freezer compartment;

a second cooling duct having an inlet and outlet in flow communication with the fresh food compartment;

an evaporator for removing heat from air flowing through the first cooling duct and from air flowing through the second cooling duct;

a first fan for removing air from the freezer compartment via the inlet of the first cooling duct, the first fan flowing the air through the first cooling duct so that the evaporator removes heat from the air, and the first fan passing the air back into the freezer compartment via the outlet of the first cooling duct;

a second fan for removing air from the fresh food compartment via the inlet of the second cooling duct the second fan flowing the air through the second cooling duct so that the evaporator removes heat from the air, and the second fan passing the air back into the fresh food compartment via the outlet of the second cooling duct; and a single damper movable between a first position in which the damper permits air flow through the first cooling duct and limits air flow through the second cooling duct, and a second position in which the damper permits air flow through the second cooling duct and limits air flow through the first cooling duct, the damper comprising a cam, a motor for moving the cam, and an opening/closing member for opening and closing the first and second cooling ducts according to the movement of the cam.

4. The refrigerator as claimed in claim 3, wherein the damper further comprises an elastic member for biasing the opening/closing member.

* * * * *